United States Patent [19]

Scherzinger

[11] 4,089,715

[45] May 16, 1978

[54] EXPLOSIVE GRADE ALUMINUM POWDER

[75] Inventor: Rudolf Scherzinger, Johannesburg, South Africa

[73] Assignee: Metal Sales Company (Proprietary) Limited, Benoni, South Africa

[21] Appl. No.: 679,461

[22] Filed: Apr. 22, 1976

Related U.S. Application Data

[63] Continuation of Ser. No. 494,311, Aug. 2, 1974, abandoned.

[30] Foreign Application Priority Data

Sep. 5, 1973 South Africa ..... 73/236092

[51] Int. Cl.[2] ..... C06B 45/32

[52] U.S. Cl. ..... 149/6; 149/5; 149/21; 149/108.2; 149/114

[58] Field of Search ..... 149/3, 5, 6, 21, 44, 149/109.4, 114, 108.2, 494, 311; 427/216

[56] References Cited

U.S. PATENT DOCUMENTS

| | | | |
|---|---|---|---|
| 1,375,243 | 4/1921 | Weber | 149/1 |
| 3,047,441 | 7/1962 | Baker | 149/109.2 |
| 3,133,841 | 5/1964 | Kuehl | 149/5 |
| 3,188,253 | 6/1965 | Patrick | 149/1 |
| 3,297,502 | 1/1967 | Chrisp | 149/6 |
| 3,367,805 | 2/1968 | Clay et al. | 149/114 |
| 3,764,419 | 10/1973 | Sheeran et al. | 149/3 X |
| 3,791,255 | 2/1974 | Fox et al. | 149/21 |
| 3,919,013 | 11/1975 | Fox et al. | 149/6 |

*Primary Examiner*—Edward A. Miller

*Attorney, Agent, or Firm*—Cushman, Darby & Cushman

[57] ABSTRACT

An explosive grade aluminium composition comprises an admixture of aluminium powder and a subdivided carrier therefor having a bulk density less than or equal to that of the aluminium powder and wherein at least part of the powder adheres to the carrier, a coating agent being optionally included in the admixture to facilitate the adhesion of the powder to the carrier.

1 Claim, No Drawings

EXPLOSIVE GRADE ALUMINUM POWDER

This is a continuation, of application Ser. No. 494,311, filed Aug. 2, 1974, now abandoned.

This invention relates to finely subdivided aluminium which is used in admixture with other chemicals to form an explosive composition, and such subdivided aluminium will be hereinafter termed "an explosive grade aluminium composition".

Explosive grade aluminium compositions should have, in order to obtain the desired reaction rates, as large a surface area as possible and also a bulk specific gravity of about 0,7 to 1,4 depending on requirements. Also, these compositions should be flowable and should retain this characteristic over prolonged periods of time in order to facilitate mixing thereof with the other chemicals on site.

A suitable form of aluminium has in the past been obtained by subdividing aluminium foil and thereafter rolling or otherwise treating the foil to form rough granules of aluminium. Whilst explosive grade aluminium produced in this manner is highly effective and retains its flowability, the supply of aluminium foil is limited and it is often uneconomical to produce such foil for this purpose. Further, aluminium powder which is produced generally by an atomizing process tends to pack solid and is therefore generally unsuitable for this purpose.

It is an object of this invention to provide explosive grade aluminium compositions which possesses the desired properties and which is not composed solely of granules produced from aluminium foil.

A further object of this invention is to provide explosive grade aluminium compositions which reduce the dangers of explosion during handling thereof or during subsequent mixing operations.

In accordance with this invention there are provided explosive grade aluminium compositions comprising an admixture of aluminium powder and a subdivided carrier therefor having a bulk density less than or equal to that of the aluminium powder and wherein at least part of the powder adheres to the carrier.

Further features of the invention provide for the carrier to have a bulk density less than or equal to 1 gram per cubic centimeter, for the admixture to include carrier in the range of 0,8% to 80,0% by weight and for at least an appreciable proportion of the powder to adhere to the carrier, the powder being in the form of particles ranging from 850 microns to submicron size.

Still further features of the invention provide for the carrier optionally to be treated with a coating agent to facilitate the adhesion of the powder thereto and for the subdivided carrier to comprise at least one of the materials of a group including subdivided sheet metal, such as aluminum foil treated to provide granules thereof having a large surface area in comparison with the size of the granules, wood, cellulose, foam plastics material, aerated aluminium, waxes and resins.

A still further feature of the invention provides for the coating agent to be an oil soluble basic dyestuff.

The invention also provides a process for preparing an admixture of the above defined type wherein a coating agent is utilized in the process comprising admixing aluminium powder with the carrier, treating the mixture with a coating composition dissolved in a diluent which is capable of evaporating at room temperatures and allowing substantially all the diluent to evaporate off.

Further features of this aspect of the invention provide in cases where wood particles or cellulose are used as the carrier for the premixing of the carrier with aluminium powder wherein the dimensions of the powder particles are 20 microns and smaller and with a coating composition and for the premixed admixture to be subsequently mixed with aluminium powder of larger particle size and optionally with further coating agent.

These and other features of the invention will become apparent from preferred embodiments thereof described below by way of example only.

EXAMPLE 1

In one preferred example of the invention an explosive grade aluminium composition comprises, by weight approximately 80% atomized aluminium powder: approximately 19.5% aluminium granules and from 0.4% to 1.0% of a solution of a coating agent in a light oil based diluent.

The aluminium granules are made by subdividing aluminium foil and thereafter rolling or otherwise treating the foil to form rough granules of aluminium. Furthermore, the coating agent is peferably an oil soluble basic dyestuff of the type which will disperse over the carrier particles in an approximately single molecule thick layer.

In order to produce the explosive grade aluminium composition, the aluminium powder and the granules are first introduced into a blade mixer. The mixer is closed and set running. Immediately thereafter the coating solution is added through a funnel and the mixing effected. In general a mixing time at between 5 and 10 minutes has been found to be most effective.

The product resulting from the above process has been found to have a bulk density of 0.85 – 0.9, and retains its flowability over long periods of time.

It has been found that at least some of the aluminium powder of particle size less than approximately 40 microns adheres under the above conditions to the aluminium granules. This is evident by an analysis of the aluminium powder and the final mix.

In this example, the aluminium powder used to start with has a composition according to the tabulation below which gives the percentages by weight of aluminium powder for various average particle sizes.

| size in microns | approximate percentage by weight |
|---|---|
| 600 | 1,88% |
| 250 | 19,52% |
| 150 | 12,04% |
| 105 | 15,47% |
| 60 | 28,52% |
| 45 | 13,70% |
| 30 | 8,87% |

The mixed product of Example 1 on the other hand has been found to be composed of particles of sizes given in the table below:

| size in microns | approximate percentage by weight |
|---|---|
| 850 | 2,66% |
| 600 | 63,91% |
| 420 | 4,40% |
| 250 | 19,20% |

-continued

| size in microns | approximate percentage by weight |
|---|---|
| 210 | 5,24% |
| 180 | 2,51% |
| 150 | 0,15% |
| 105 | 0,61% |
| 75 | 0,63% |
| 53 | 0,24% |
| 45 | 0,09% |
| 32 | 0,16% |

The resulting admixture comprises carrier particles having aluminium particles of less than approximately 40 microns in size adhered thereto, aluminium particles of approximately 40 microns and bigger in size, and aluminium powder of approximately 40 microns and smaller in size adhered to the larger aluminium particles.

It has been further noted that in order to prevent separation of the granules and powder their proportions should be carefully controlled to those described above ± 0.5%. However, the proportions are capable of being varied to a greater extent where a carrier other than aluminium granules is used.

EXAMPLE 2

In a further embodiment according to the present invention, an explosive grade aluminium composition comprises, by weight 92% aluminium powder and approximately 5.5% of organic substances including wood particles and its natural resin. The remaining by weight percentage is made up by coating agent similar to that described above. The sizes of wood particles are in the range of 150 to 850 microns.

In this case the mixing operation is effected by initially premixing the carrier with very fine aluminium powder wherein the particle sizes are from 20 microns and smaller and with some coating agent in a blade mixer. Thereafter, the bulk of the aluminium powder of particle sized from 20 microns and bigger and further coating material are mixed with the premixed carrier in the manner outlined above in the first embodiment.

An analysis of the particles of this admixture is given below.

| size in microns | approximate percentage by weight |
|---|---|
| 850 | 98% |
| 420 | 94% |
| 150 | 50% |
| 75 | 15% |
| 45 | 3% |

As in the first embodiment, this explosive grade aluminium composition is fairly free flowing but the above admixture has the advantage of embodying a relatively inexpensive carrier. The bulk density of the admixture is between 1,05 to 1,10 grams per cubic centimeter.

It has been found that there are many alternative admixtures possible, within the scope of this invention, which will be effective in use. The ratio of aluminium powder to carrier is variable and depending on its nature, the carrier may comprise from 0,8% to 80,0% by weight of the admixture. Also different carrier materials including cellulose, foam plastics material, aerated aluminium particles, waxes and resins separately or in combination, have proved effective. In all cases where coating agent is included in the admixture, it has been found satisfactory for the agent to comprise by weight 0,4% to 2,5% of the admixture.

In cases where foam plastics is used the preferred percentage by weight thereof in the admixture is from 0,8% to 2% while in the case of cellulose, a percentage by weight of approximately 5% has proved most effective.

It is not always essential that coating material is included in the admixture. With certain types of subdivided wood, the natural resins inherent in the wood are sufficient to ensure a reasonable adhesion between such particles and the aluminium powder.

In all cases, however, the resulting explosive grade aluminium, is flowable and it has also been found that the danger of premature explosion of the admixture during handling and during subsequent mixing has been greatly reduced.

What I claim as new and desire to secure by Letters Patent is:

1. A flowable explosive grade aluminum composition comprising an admixture of:

(1) aluminum powder having a particle size distributed between 850 microns and submicron size, said powder admixed with, (2) aluminum granules as a carrier for said aluminum powder and (3) a coating agent of an oil soluble basic dyestuff dispersed over the carrier particles in an approximately single molecule thick layer, to adhere the aluminum powder to the carrier, the resulting composition having at least part of said aluminum powder adhered thereto such that the composition has:

(a) a bulk density of the order of 0.7–1.4, (b) carrier particles with aluminum particles of less than approximately 40 microns in size adhered thereto, (c) aluminum particles larger in size than approximately 40 microns, (d) and aluminum particles of approximately 40 microns and smaller in size adhered to aluminum particles of larger size, the resulting composition being flowable.

* * * * *